US006761009B1

(12) United States Patent
Karlström et al.

(10) Patent No.: US 6,761,009 B1
(45) Date of Patent: Jul. 13, 2004

(54) METHOD AND ARRANGEMENT FOR WOOD STUDS

(76) Inventors: Johan Tore Karlström, Vikingagränd 6, Fin-22150 Jomala (FI); Johan Mikael Karlström, Skarpansvägen 27 C 7, Fin-22100 Mariehamn (FI)

( * ) Notice: Subject to any disclaimer, the term of this patent is extended or adjusted under 35 U.S.C. 154(b) by 0 days.

(21) Appl. No.: 09/889,573

(22) PCT Filed: Jan. 26, 2000

(86) PCT No.: PCT/FI00/00052

§ 371 (c)(1),
(2), (4) Date: Oct. 5, 2001

(87) PCT Pub. No.: WO00/45006

PCT Pub. Date: Aug. 3, 2000

(30) Foreign Application Priority Data

Jan. 28, 1999 (FI) ..... 990161

(51) Int. Cl.[7] ..... E04C 3/30; B27B 1/00

(52) U.S. Cl. ..... 52/730.7; 52/729.4; 144/355; 144/378

(58) Field of Search ..... 52/729.1, 729.4, 52/730.7; 156/264, 269; 29/897.35; 144/344, 345, 355, 378

(56) References Cited

U.S. PATENT DOCUMENTS 1,377,891 A * 5/1921 Knight
3,079,649 A * 3/1963 Willatts
4,839,816 A * 6/1989 Cattrall et al. ..... 700/167
4,879,659 A * 11/1989 Bowlin et al. ..... 700/167
4,967,534 A * 11/1990 Lines
5,022,211 A * 6/1991 Scott
5,115,609 A * 5/1992 Sing
5,207,046 A * 5/1993 Vekkeli
5,323,584 A * 6/1994 Scarlett
5,421,386 A * 6/1995 Lundstrom ..... 144/357
5,865,929 A * 2/1999 Sing
5,881,520 A * 3/1999 Blazevic
5,896,723 A * 4/1999 Sing
6,162,312 A * 12/2000 Abney
6,279,629 B1 * 8/2001 Sing
6,318,046 B1 * 11/2001 Horsfield et al. ..... 52/730.7
2002/0043042 A1 * 4/2002 Horsfield et al. ..... 52/731.1

FOREIGN PATENT DOCUMENTS

EP 0388507 A2 9/1990
NO 64588 C1 3/1942
SE 469880 B 10/1993

* cited by examiner

*Primary Examiner*—Carl D. Friedman
*Assistant Examiner*—Kevin McDermott
(74) *Attorney, Agent, or Firm*—Arent Fox PLLC

(57) ABSTRACT

The present invention relates to a method for manufacturing studs (9) or the like generally oblong pieces comprising a central web (14) and opposite flanges (8*a*, 8*b*) connected thereto. The present invention also relates to a stud system comprising such studs, as well as to methods for attaching such studs between an upper and a lower surface. Said flanges (8*a*, 8*b*) are formed of an essentially latch-like waste wood material which has been generated in mechanical wood processing, whereby a contact surface (13) is formed at the side of a respective opposite flange latch (8*a*, 8*b*) for co-operation with a surface (13*a*) shaped in a corresponding manner at a web (14) which also is made of wood, suitably of said waste wood material. Said contact surfaces (13, 13*a*) are glued, favorably under press, together so that said web (14) and said flanges (8*a*, 8*b*) attached thereto form an essentially monolithic entity. Vertical studs are attached to corresponding horizontal studs which are arranged at least at said lower surface.

16 Claims, 4 Drawing Sheets

METHOD AND ARRANGEMENT FOR WOOD STUDS

Figure 1:
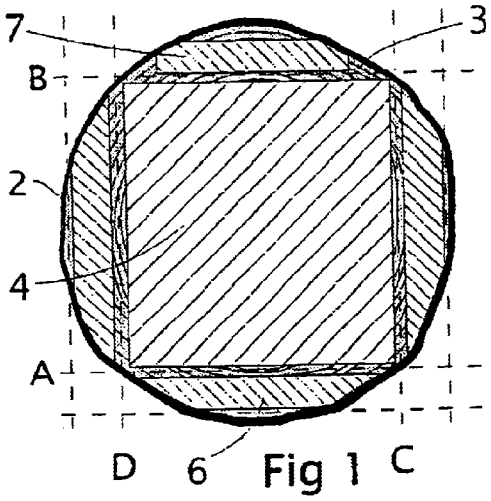

The present invention relates to a method for the production of wood studs or the like generally oblong pieces comprising a central web and opposite flanges attached thereto as disclosed in the preamble to appended claim 1. The invention further relates to a system comprising such studs as well as to further methods for attaching, between upper and lower surfaces, vertical studs of the kind as disclosed above.

In building industry wood is traditionally used for structures of many kinds, but the use of wood, e.g., for posts and cross-bars has in course of time declined in favor of metal studs. The reason for this has been mainly economical, since metal studs nowadays can be manufactured to a more favorable price than wooden studs having the same properties. Moreover, metal studs have the advantage that they are lighter than usual wooden studs and the do not, for example, twist. To this is normally added a certain possibility to pile the studs. Again, a clear disadvantage for metal studs, on the other hand, is that any shaping of the material requires special tools and arrangements, and the result of such a shaping usually will be uneven and jagged. Further, an attachment of, e.g., wallboards to the studs requires special arrangements. Thus, there would exist a market for wooden studs, provided that the costs could be kept low and the studs structurally would be more shape permanent than is the case with known studs and posts.

In mechanical wood processing like sawing the primary raw material always will be round timber, wherefrom one or several wood blocks are taken out in the form of parallelepipeds having, respectively, two opposite parallel planar surfaces. Later on this planar wood can be processed and thus different kinds of more finished products can be obtained, but the out-side boards, i.e. wood pieces normally comprising only one planar side true to gauge while the opposite side at most comprises a planar surface of reduced dimensions and usually only more or less semi-round portions, can normally not be effectively used. To some extent such defective sawn goods has been used as basic material for small dimension laths and the like, but often the useful use is restricted to a function as fire wood or, in a restricted scale, as raw material for the cellulose industry. A common way to further refine this waste wood material is to cut it to chips, in which case all inherent structure will be lost.

Besides the fact that this waste wood material normally comprises a round and a planar side a common problem is considered to reside therein that the dimension at the top end of the log is smaller than the dimension at the root end, for which reason one must take out log blocks having dimensions based on the top end in order to obtain full edge wood material. In this way further wood material is lost, for which a full price cannot be obtained. The price for the raw material discussed above mainly corresponds to the fire wood price, while the price for first class wood is much higher. Thus, this waste material would constitute a favorable raw material for, for example, studs and posts, provided that the manufacturing costs could be kept low and that a sufficient quality and shape permanence of the product could be maintained.

In the course of time one has tried to find different ways to utilize this waste wood material in a manner which makes use of the material's strength properties. Thus, DE-Patent document No. 29 47 611 discloses a rather complicated arrangement for the manufacture of wooden slats or panels based on round timber by wetting the material, sawing it to boards having a conicity corresponding to that of the log, and by press gluing boards having an opposite conicity and arranged in a parallel manner to interconnect these boards to larger entities.

Again, SE-Patent application No. 9001337-6 discloses an arrangement where, in the same manner, it is suggested the use of opposite conicities in order to form, of four blocks, a hollow stud having a rectangular section, the inner of which being delimited by the outer surface and the conicity of the round timber. Finnish Patent No. 93567, again, discloses a way to form, by sawing round timber longitudinally into four sections, studs where one side comprises an inner V-shape.

The object of the present invention is to provide a method for producing studs and the like structures which can take up competition with corresponding metal studs and which effectively makes use of the waste material which is generated at mechanical wood processing and especially the material which is left over at round timber sawing when a wood block of a rectangular section is taken out.

According to the present invention the object is attained by the features indicated as characterizing ones in the appended claims. Thus, the inventive method is characterized in that the flanges are formed of essentially lath-like waste wood material generated at mechanical wood processing, wherein a contact surface is formed at the side of each respective opposite flange lath for co-operation with a surface shaped in a corresponding manner at a web also made of wood, suitably of waste wood material as discussed above, and that said contact surfaces are glued together, favorably under pressure, so that said web and said flanges connected thereto will constitute an essentially monolithic entity. The stud system according to the present invention is characterized in that said studs are formed in such a manner of pieces of essentially lath-like waste wood material which has been generated at mechanical wood processing that at least each respective flange comprises a longitudinal side portion which, in lateral section, is beveled, wherein a number of such flanges are glued to said web in order to form an essentially monolithic structure where said beveled side portions at opposite flanges are directed towards each other.

The methods for attaching the stud in accordance with the present invention is generally characterized in that one respective horizontal stud or crossbar manufactured by gluing together waste wood material to have an essentially U-shaped cross section is arranged at said upper and lower surfaces. That end of a vertical wooden stud or post which is directed towards said lower horizontal stud is shaped to essentially correspond to the inner section of said horizontal stud, so that the web of the vertical stud will extend between the flanges of the horizontal stud towards, favorably all the way to the web of said horizontal stud, in some case into openings between spaced web portions, while the ends of the flanges of the vertical post will lie close to the upper edge of said horizontal stud. The upper end of the vertical post, which post has been cut to a suitable length, is introduced into a locking device which co-operates with the horizontal stud arranged at the upper surface, said locking device comprising a resilient element, after which, if necessary, said vertical post is fixed in a manner known per se, e.g., by nailing, screwing, and/or gluing, to said horizontal studs. In most cases the post will, in practice, be slightly stressed or wedged in between the respective horizontal studs, so that any further attachment usually is quite unnecessary.

Alternatively, a U-shaped horizontal stud or crossbar manufactured by gluing together waste wood material is arranged only at one of said surfaces, while a thin-walled rail having an essentially U-shaped section and made of metal or the like is arranged at the opposite surface, said rail suitably having holes at least a the flanges. One end of the vertical post is shaped in accordance with the above while the other end is cut transversely to such a length that this end at the assembling will be located within the transverse U-shaped section of the metal stud approximately at its bottom or suitably at some distance therefrom, suitably up to 40 to 50 millimeters from said bottom for a flange width of 60 millimeters, in order to facilitate the introduction and attachment and in some cases also to allow a vertical motion for, e.g., an overlying structure and the horizontal stud attached thereto. The vertical post is introduced between said studs, after which, if necessary, said vertical post is fixed to said horizontal studs in a manner known per se.

Figure 5:
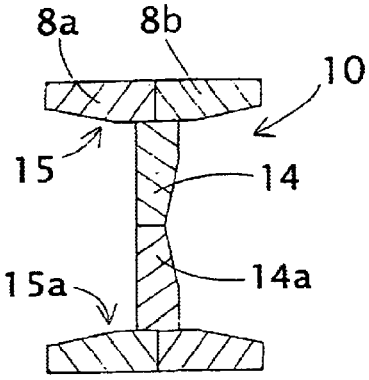
Figure 6:
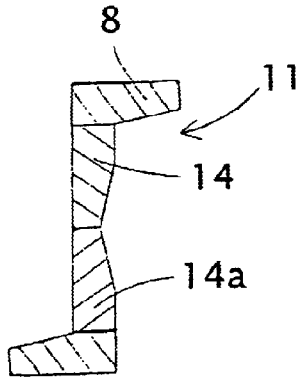
Figure 12:
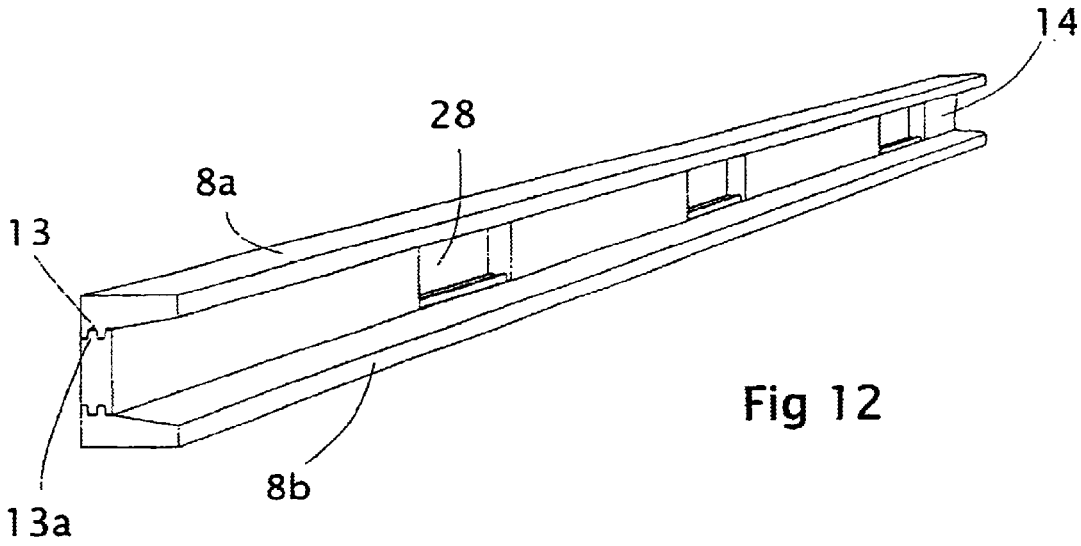
Figure 7:
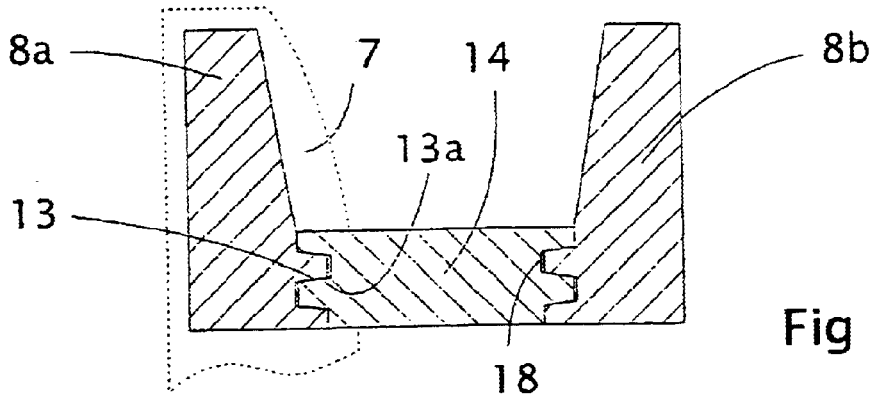
Figure 8:
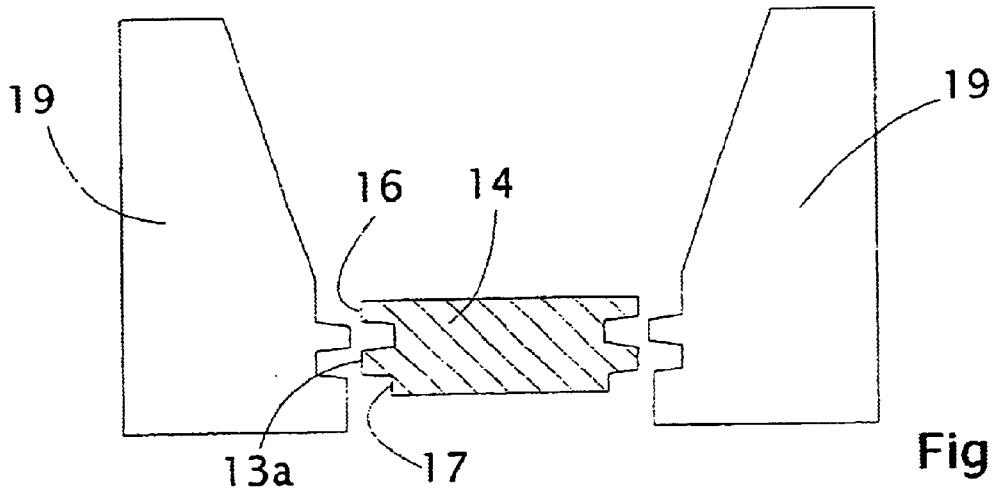
Figure 9:
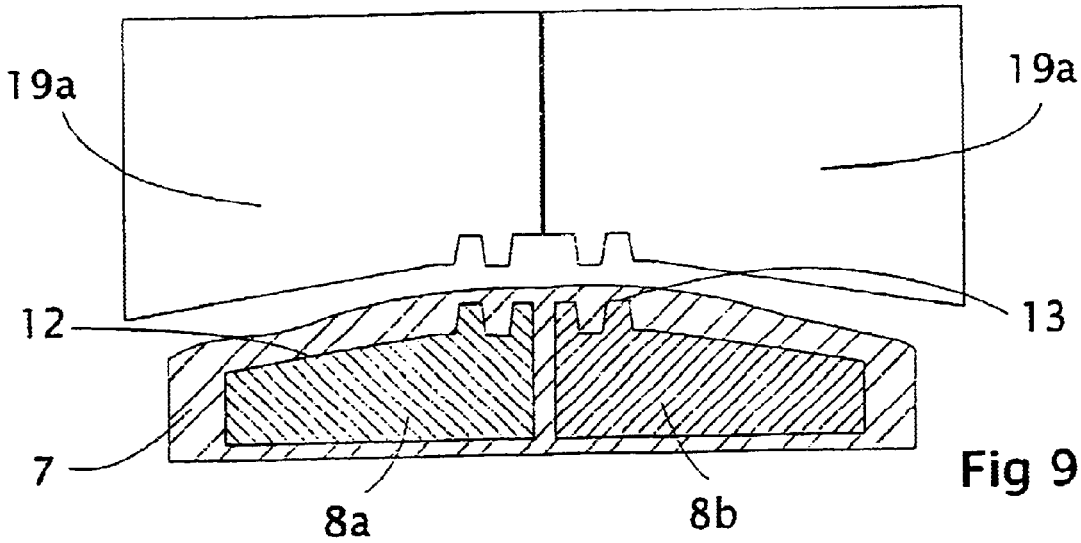
Figure 11:
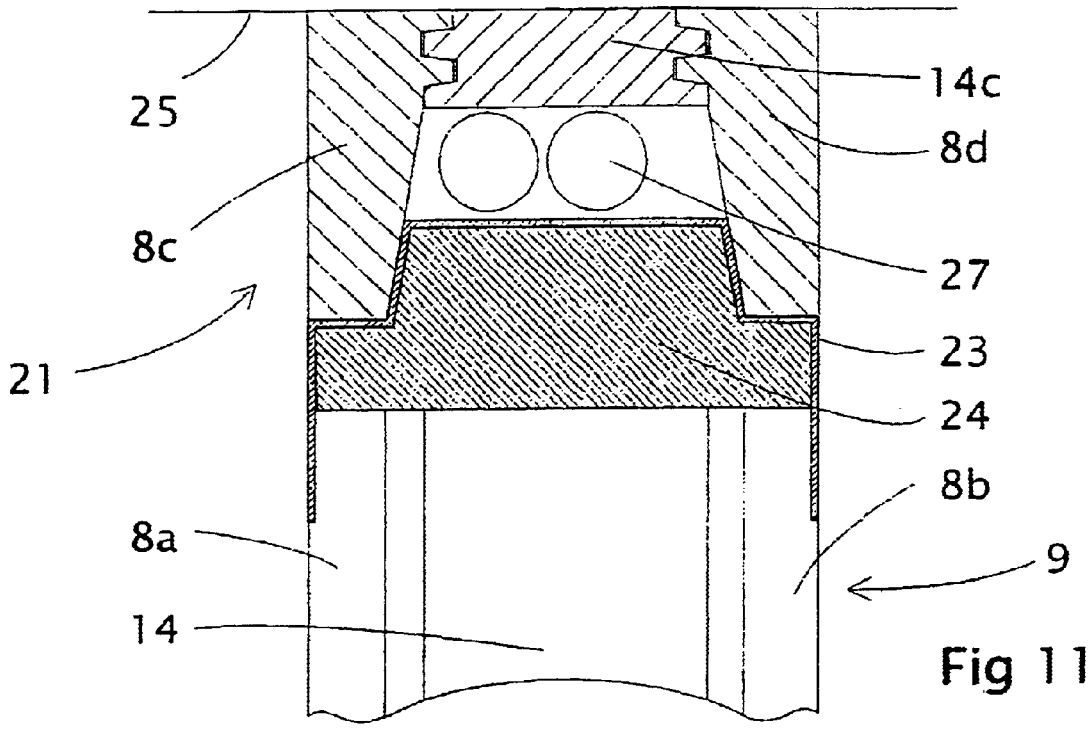
Figure 10:
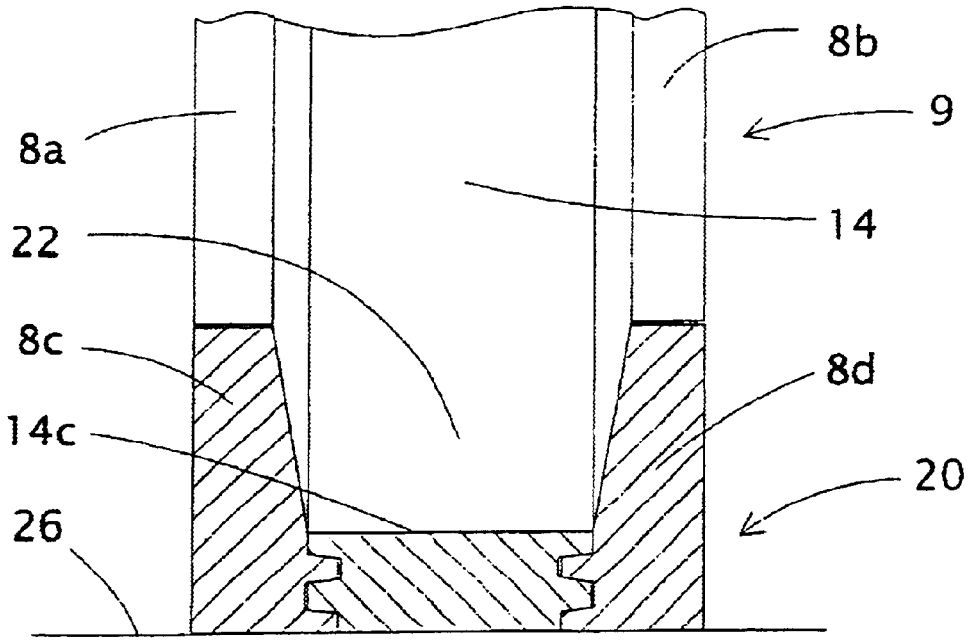

The invention will now be described in more detail with reference to the appended drawings which as an example only disclose some preferred embodiments of the present invention, and wherein FIG. 1 in a schematic manner and seen from the smaller end discloses a round log from which rectangular sawn blocks are taken out, FIG. 2 discloses the same sawn blocks as well as the laths or rims formed at the outside boards, FIG. 3 discloses a wane or outside board, FIGS. 4*a* to 4*c* generally disclose alternative cross sections of U-studs in accordance with the present invention, FIG. 5 in a corresponding manner discloses a stud having an I-shaped cross section, FIG. 6 in a corresponding manner discloses a stud having a generally Z-shaped cross section, FIG. 7 in section discloses an especially favorable embodiment of a U-stud in accordance with the present invention, FIG. 8 schematically discloses the manufacturing of a web for the U-stud according to FIG. 7, FIG. 9 in a corresponding manner discloses the manufacturing of the flanks for the same U-stud, FIG. 10 discloses the attachment of a stud to a floor, FIG. 11 in a corresponding manner discloses an example of the attachment to a ceiling, and FIG. 12 in perspective generally discloses a stud in accordance with a favorable embodiment of the present invention.

Figure 2:
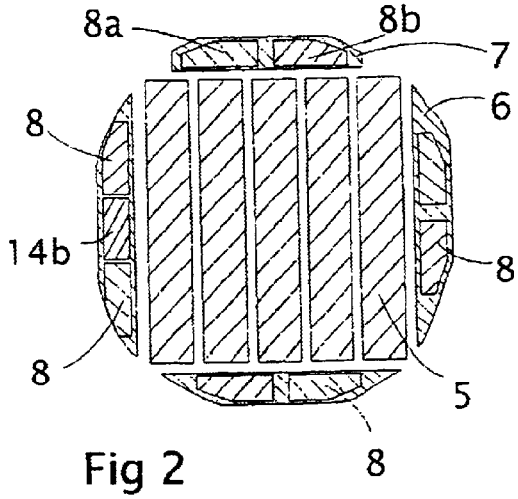

FIG. 1 discloses a round log generally referred to as 1, said log being debarked in a normal manner or, in exceptional cases, having an outermost layer of bark 2 surrounding the wood 3. A central block 4 of wood is taken out from the wood portion 3, usually by sawing along cuts A, B, C and D, said block having a more or less quadrilateral cross section. In the Figures the width of said cuts A to D are shown slightly magnified for the sake of clarity. The central block 4 can be used, as such, as heavy timber or it can be sawn in a further sawing operation to full edged battens or boards 5, as schematically disclosed in FIG. 2.

However, a round log 1 includes, besides said central block 4, also wood portions 6 or so-called outside boards which are located outside said block 4 and have an essentially half-round section. Further, since a round log 1 normally is slightly conical, longer full blocks will simultaneously provide longer outside board portions 6 having at an least partially half-round edge. These outside board portions 6 can often be sawn to form wane edge boards 7 having two opposite planar surfaces but having totally or partially half-round sides. Such wood may be used for simpler purposes where the appearance or the shape of the wood does not have any essential significance, for example as laths or certain kinds of panels, but until now this material has not found any use for more demanding purposes, and thus these portions 6 will have a price by volume which is considerably lower than that of the full side block. Often said wane edge waste wood cannot be used for any kind of structural purposes, but will be burnt as wood or chips, even though the structural strength of this wood usually is fully in class with the strength of full edge wood.

Now, the present invention provides a totally new use for the waste wood constituted by a log's wane edge portions 6, 7. Simultaneously, a stud system is provided, which to its mechanical function is fully comparative with a stud system made of sheet steel, but where a tooling of the studs can be performed with usual carpenter's tools and methods. According to the present invention said wane edge portions 6, 7 of a log 1 are expressly utilized for the forming of battens or laths 8 in order to form flanges 8*a*, 8*b* for a stud 9, 10, 11, which suitably is U-, I- or Z-shaped in section, as disclosed in a generally exemplifying manner in FIGS. 4*a* to 4*c*, 5 and 6, or, for example, in a corresponding manner T-shaped (not shown in more detail).

Figure 3:
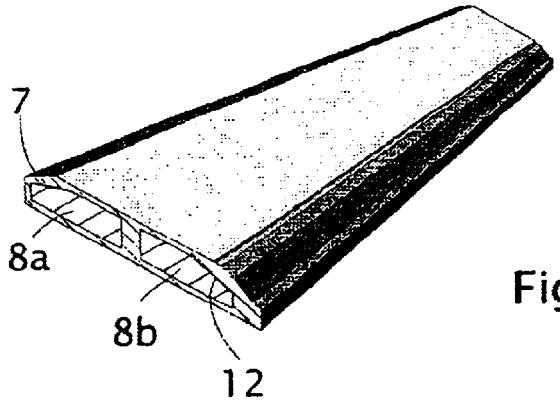

As disclosed in FIG. 3, the lath shaped flange portions, i.e. battens or laths 8*a*, 8*b* are taken out, e.g. by sawing, from that part 6, 7 of the log 1 which constitutes the cheapest portion and for which the use until now has been restricted to clearly secondary applications. In the production at least those portions of lath-like waste wood material 8 is processed, which will constitute said flanges 8*a*, 8*b*, in order to obtain essentially equal dimensions at each respective section, thus to form mutually co-operating contact surfaces 13, 13*a*. This section comprises suitably four mutually paired parallel sides and further one side 12 which is inclined with respect to said parallel sides. Thus, the general shape of said laths 8, 8*a*, 8*b* is defined essentially by the shape of the wane edge board 7, i.e. said laths have, in section, a beveled edge 12 along one side. Suitably, this beveled edge 12 ends at a portion of the lath's side which constitutes the contact surface 13 to be glued to a corresponding contact surface 13*a* at the stud's 9, 10, 11 web 14, 14*a*. As disclosed in FIG. 4*a*, said web 14, 14 can, as such, have essentially the same shape as said flanges 8*a*, 8*b*, and it can be taken out of the waste material 6, 7 in the same way as these. Alternatively, said web 14, 14*a* can be manufactured of full edge lath material 14*b*, see FIG. 4*b*, or of shorter portions of such material (see below), in which case the material favorably is taken out of said waste material either separately or, e.g., between said beveled flange laths 8, see FIG. 2, or taken out of such longer waste portions which are obtained when said flange material is cut off from longer portions of standard length (see below).

By gluing together several parallel laths 8, 14*b* to obtain said stud 9, 10, 11 a counteraction against any twist in the finished stud 9, 10, 11 is achieved already as such, which provides a good shape permanence also at building sites where the moisture conditions vary. In the embodiments disclosed said flanges 8*a*, 8*b* are further suitably manufactured in pairs taken from the same wane edge board 7, in which case such portions of material 8*a*, 8*b* are achieved, which structurally constitute mutual mirror images. This arrangement provides, as a separate advantage, that any twisting of the completed stud 9, 10, 11 is counteracted by the fact that said flanges 8*a*, 8*b* already as such tend to twist, e.g., in a drying stage, to opposite directions.

Figure 4A:
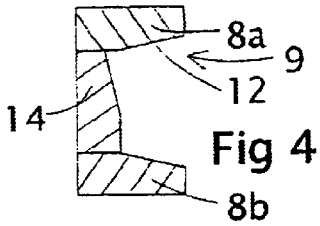
Figure 4B:
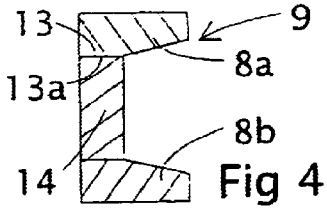
Figure 4C:
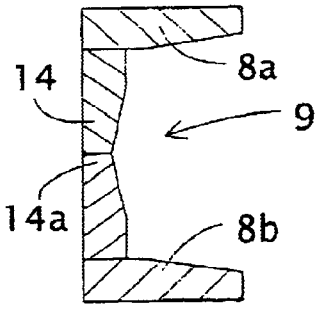

FIGS. 4*a* and 4*b* disclose relatively slender U-studs which favorably are used for partitioning walls having a wall thickness of up to 100 millimeters, which is usual, e.g., in partitions in office buildings and the like. Typically, the width of said stud 9, 10, 11 is 60 to 90 millimeters and the width of the side flange correspondingly 30 to 50 millimeters, sometimes even more than 60 millimeters. The side thickness of said side flange 8*a*, 8*b* is, at the thinner edge, favorably at least 10 millimeters, which provides a satisfactory stability for the complete stud 9, 10, 11. A U-stud 9 for larger wall widths is disclosed in FIG. 4*c*, where the width of the stud 9 typically is 90 to 100 millimeters. In this embodiment the web suitably is constituted of two laths 14, 14 glued together in a side-to-side disposition towards each other. In a corresponding manner FIGS. 5 and 6 disclose studs 10, 11 having I- and, respectively, Z-shaped sections. These studs 10, 11 are especially useful as general structural elements like girders and rafters or the like. In an I-stud as disclosed in FIG. 5 two beveled laths 8*a*, 8*b*, respectively, are glued together side-by-side to form the stud's respective opposite flanges 15, 15*a*. Since the stud in accordance with the invention as an entity and especially with respect to its flanges will be clearly stiffer than the flanges at corresponding metal studs of the same outer dimensions the inventive stud will fit without any modifications also in such surface covering systems where the flanges are wider than 35 millimeters, which for steel studs is considered as the maximum width, when one takes in account that the flange must not bend away during a screwing.

FIG. 7 discloses an especially favorable embodiment of the present invention, wherein two opposite adjacent contact surfaces 13, 13*a* to be glued together are shaped as groove-and-tongue-like surfaces having intermeshing or interdigitated essentially parallel, appropriately slightly wedge-shaped tongue- 16 and, respectively, groove structures 17, which favorably are doubled. Said groove-and-tongue structures 16, 17 are suitably gauged so that a space 18 is formed between the outer end of said tongue 16 and the bottom of said groove at the assembled stud 9, 10, 11 into which space any possible excess glue can be pressed at the gluing procedure, which favorably takes place under press using glues and gluing methods known per se.

The parts for the stud 9 disclosed in FIG. 7 are manufactured, in a manner discussed above, of waste material, and specially shaped plane- or cutter blades or the like tools 19, 19*a* are favorably used in the manufacture in order to produce, suitably in one machining operation stage only, the contact surfaces 13, 13*a* which at said laths 8 constitute the stud's 9 flanges 8*a*, 8*b* and web 14, respectively. Said tool 19*a* is favorably shaped so that it simultaneously will shape the beveled side 12 of said flanges 8*a*, 8*b*. It should be clear that the favorable embodiments discussed above in connection with FIGS. 7 to 10 and comprising a groove-and-tongue arrangement also can be utilized for other sectional shapes, e.g, for the embodiments according to FIGS. 4*c* to 6.

Flanges 8*a*, 8*b* and webs 14, 14*a*, respectively, shaped in accordance with the above are glued together, in a manner known per se, to form a raw stud 9, 10, 11, which still can be surface conditioned, if necessary. For this purpose the studs 9, 10, 11 can be primarily gauged to include, in at least one direction, a dimension which is slightly wider than the final one, in which case the stud 9, 10, 11 is treated after gluing in order to obtain its final desired dimensions. However, according to an especially favorable embodiment of the present invention the machining of the raw material and the forming of said flanges 8*a*, 8*b* and said web 14 is made with such a precision that such an aftermachining in normal case can be totally avoided. Favorably, the manufacturing can also be effected so that the stud material already during a premachining stage will correspond also in the longitudinal direction to a final standard gauge for studs.

By the gluing a monolithic structure is established which to its strength fully corresponds to corresponding known studs made of steel sheet, but which have a lower weight, are easier to work and where the production costs are lower than for corresponding steel studs. Wooden studs 9, 10, 11 according to the present invention are manufactured of a renewable natural resource, and the total energy consumption during the production is only about 20% of the total energy consumption for the production of steel sheet and forming of studs therefrom.

The stud 9, 10, 11 in accordance with the invention is straight, it utilizes an otherwise essentially unusable raw material and it can be manufactured also in relatively large dimensions where corresponding studs of sheet metal have a tendency to bend, i.e. the stud flange gives way when one tries to attach a pane to the flange. In order to avoid this one must, for metal studs having a flange width of more than 35 millimeters, use a thicker sheet which brings about a considerably higher weight and a more cumbersome assembling, since the use of self-threading screws in thick sheet metal is problematic. These problems can be totally avoided with studs according to the present invention, where the requirements regarding flange stiffness not will have any impact on the selection of screws and the like. A wooden stud will have the further advantage that the stud can be provided with all kinds of grooves and/or the like formations for rims, sealings or the like details, and this can be done using simple means either prior to the assembling, during it or thereafter.

A normal stud for partitioning walls and the like have a length of about 2.5 meters, which allows the use of also shortish wood like, e.g., 3 meter long pulp wood for the manufacture of a stud 9, 10, 11 in accordance with the present invention. Usually it is possible to make use of any possible waste pieces for the manufacture of said webs 14, 14*a* thereof, which normally does not even require any finger jointing. According to an especially favorable embodiment of the present invention (see FIG. 12) the web 14, 14*a* of the stud is made of short pieces which, in the longitudinal direction of the stud are located mutually spaced apart so that, in practice, openings 28 are formed in the web. These openings 28 do not have any essential impact on the strength of the stud but they facilitate a much more effective use of waste pieces. Simultaneously, said openings constitute lead-throughs for pipes, wiring and the like. Thus, when said pulp wood is used said webs 14 favorably comprise pieces having a length of about 25 to 50 centimeters, suitably, e.g., 30 centimeters, with a mutual axial space of about 5 to 15 centimeters, usually about 10 centimeters. In this way material will be saved and also waste material can be used, the weight of the stud will be lower, and besides said lead-throughs the openings can, as such, be used as supporting attachment points between horizontal and vertical studs.

The studs 9, 10, 11 according to the invention have the further advantage that any separate reinforcement of, e.g., the opening for a door or the like often can be avoided, which normally must be made for metal studs. If necessary, a stud according to the invention can locally be reinforced by attaching further pieces of wood to the stud. Such a reinforcement can be made very effective, if the reinforcement is, e.g., glued to the stud, which cannot normally be done for metal studs. The attachment of a door case is also much easier at a stud in accordance with the invention, since, for example, nailing or screwing with normal wood screws can be used. It is also much easier to nail floor or door skirtings to a wooden stud 9, 10, 11 than to attach them to a metal stud, and this makes it possible also for persons having only experience of working with wood to use the inventive stud.

The rising of, e.g., partitioning walls utilizing the inventive wooden studs 9 will, in principle, take place in the same manner as for corresponding metal studs. In industrial building using, e.g., gypsum wallboards attached with self-boring and -threading screws to metal studs the rising of the studs are performed as a first operation, after which the piping for, e.g., electrical installations is made prior to the attachment of the wallboards. A wooden stud 9 attached in accordance with the present invention can then be used in the same manner as a metal stud, i.e. it permits a certain lateral displacement in the assembling, which has not been possible with known studs made of massive wood. This displacement is usually necessary in order to facilitate the adaptation of the studs to wallboard seams or the like. According to the present invention such an adaptation will be possible since the stud 9 according to the invention not primarily need to be nailed to the horizontal studs arranged for this purpose, i.e. floor and ceiling railing 20, 21 as in the case disclosed in FIGS. 10 and 11, but they will stay in place with a lip 22 which easily is formed in the stud's web 14, 14*a*, see FIG. 10. At least the lower one of said rails 20, 21 is favorably constituted of wooden studs essentially identical with the vertical studs 9 in accordance with the invention.

At the lower end the stud's 9 web 14, 14*a* will extend in the shape of a tongue down between the flanges 8*c*, 8*d* of the horizontal stud 20, 21 toward, suitably all the way to the web 14*c* of the horizontal stud 20, 21. Especially for the ceiling 25, in accordance with a favorable embodiment of the invention, see especially FIG. 11, a special locking sleeve 23 of metal or the like is used at the upper end as a locking means for the stud 9, into which sleeve the end of the vertical stud 9 is introduced for co-operation with a spring element 24 and/or a resilient mass located in said sleeve. In the embodiment disclosed a space is arranged between the ceiling 25 and the upper end of the stud 9 for piping 27 or the like. Such a space can, of course, also be arranged at the floor 26. According to an alternative embodiment of the invention either one of said horizontal studs 20, 21 or both horizontal studs are made of metal. Especially at the floor end, however, a horizontal wooden stud 20, 21 is especially favorably, since a wooden horizontal stud easily permits the attachment of, e.g., floor skirtings by nailing. Since the trend today goes towards the omitting of cornice molding but that skirtings still are used at the floor a probable use will include horizontal wooden studs 20 at the floor and, respectively, metal studs 21 at the ceiling.

Above is disclosed, only as examples, some favorable embodiments of the present invention, but for the professional it is clear that the present invention can be implemented also in other ways within the scope of the appended claims. It is, e.g., in certain cases appropriate that at least a part of the machining takes place at one location and the assembling is made at another location, and in certain cases the assembling and the gluing together of the studs even can be effected in the close vicinity of location where the stud will be finally used. Since the premachining of the stud's web 14, 14*a* and flanges 8*a*, 8*b* favorably is performed in automatic machines having a high degree of precision the quality and the fitting shape of the intermediate product will be such that it, as such, can be offered for sale as a semi-manufacture, for which the assembling can take place also at another location and with simpler means. It can even be done only with a hammer, in which case the transportation will be simpler due to the reduction of empty space. It is also clear that, for thick wood, in certain cases also full edge pieces can be extracted from between the half-round portions which constitute raw material for the stud in accordance with the invention, and these portions can be used in a traditional manner. Also this embodiment is considered to constitute a part of the present invention. The studs according to the invention can also easily, e.g., by painting or in connection with the press gluing, be provided with different kinds of markings to indicate positions, lengths and the like information.

What is claimed is:

1. A method for the production of studs or oblong pieces comprising a central web formed of wood and opposite flanges connected thereto, said method comprising:

providing waste wood material of a wane edge portion of a log, said waste wood material comprising laths in an original state obtained during wood processing;

machining said laths to constitute said central web or opposite flanges, wherein said laths have an original dimension exceeding the dimension of each central web or opposite flange;

forming a first contact surface at a side of each opposite flange for co-operation with at least one second contact surface, a second contact surface shaped in a corresponding manner on said central web; and gluing together each of said first and second contact surfaces so that said central web and said opposite flanges connected thereto constitute a monolithic entity.

2. A method according to claim 1, wherein said laths are formed in pairs from a wane edge board or an outside board which is obtained from the log.

3. A method according to claim 1, wherein at least the pieces of waste wood material which constitute said flanges are machined in order to obtain, essentially equal dimensions at each respective section, and thus to form said first and second contact surfaces, so that said section comprises four sides being mutually parallel in pairs, as well as a further side which is inclined in relation to said four sides.

4. A method according to claim 1, wherein at least one longitudinal edge at at least two respectively opposite pieces of said laths is machined to form adjacent intermeshed groove and tongue formations, so that the longitudinal edge comprises at least two tongues.

5. A method according to claim 1, wherein said studs are primarily gauged to comprise, in at least one direction, a dimension which is slightly larger than a final dimension, and wherein said studs are treated after gluing so as to obtain final desired dimensions.

6. A method according to claim 1, wherein laths from opposite locations in said log constitute said web and flanges, in order to counteract thereby a deformation of the stud.

7. A stud system comprising studs having a central web and flanges connected thereto, wherein said studs comprise:

a waste wood material of a wane edge portion of a log generated in wood processing, said waste wood material comprising laths constituting a central web or flanges and having an original dimension exceeding the dimension of each web or flange, said studs formed so that at least the flanges comprise a longitudinal sectionally beveled side portion, and wherein a number of said flanges are glued together with said web in order to form a monolithic structure where said beveled side portions of opposite flanges are directed towards each other.

8. A stud system according to claim 7, wherein each web or flange comprises at least two separately formed pieces of lath which are glued together so that equally wide short sides are mutually facing each other.

9. A stud system according to claim 7, wherein all lath pieces of waste wood material are of the same dimensions and sections.

10. A stud system according to claim 7, wherein side portions at each flange comprise a longitudinal lateral first contact surface arranged to be connected to an opposite longitudinal lateral second contact surface shaped in a corresponding manner at the intermediate web, so that the first and second contact surfaces of said flange and web constitute an intermeshing groove and tongue structure.

11. A method for attaching, between an upper and a lower surface, a vertical wooden stud comprising a web and flanges connected thereto, said method comprising:

arranging in section U-shaped horizontal studs at said upper and lower surfaces, said U-shaped horizontal studs glued together of waste wood material of a wane edge portion of a log, said waste wood material comprising laths having an original dimension exceeding the dimension of each web or flange, shaping an end of the vertical wooden stud which is directed towards the lower horizontal stud to correspond to an inner section of said lower horizontal stud so that the web of said vertical stud extends between the flanges of said lower horizontal stud down towards the web of the lower horizontal stud, while an end of each flange of the vertical stud rests against an upper edge of each flange of the horizontal stud, introducing an upper end of the vertical stud into a locking device which co-operates with the upper horizontal stud, said locking device comprising a resilient element, and optionally, fixing said vertical stud to at least one of said horizontal studs by (1) nailing or screwing, (2) nailing or screwing and an additional gluing, (3) nailing or screwing and an additional jamming, or (4) nailing or screwing and additionally gluing and jamming.

12. A method according to claim 11, wherein a sleeve of metal is used as said locking device, into which the end of said vertical stud is introduced for co-operation with a spring element or a resilient mass located in said sleeve.

13. A method for attaching vertical wooden studs, between an upper and a lower surface, wherein the method comprises arranging in section a U-shaped horizontal stud at one of said surfaces, said U-shaped horizontal stud formed by gluing together waste wood material of a wane edge portion of a log, said waste wood material comprising laths having an original dimension exceeding the dimension of a respective flange, arranging a thin-walled in section U-shaped metal stud at the other one of said surfaces, where at least said flanges of the U-shaped metal stud are perforated, shaping an end of said vertical wooden stud, said vertical wooden stud directed towards said horizontal stud, in such a manner that an end profile thereof in the lateral direction corresponds to the projection of said horizontal stud in the longitudinal direction, assembling an opposite end of said vertical stud cut transversely to such a length that the opposite end is located within the U-shaped section of the metal stud, introducing said vertical stud between said studs arranged at said surfaces, and optionally fixing said vertical stud to said horizontal studs.

14. A stud or oblong piece comprising a central web formed of wood and opposite flanges connected thereto, said flanges formed of lath waste wood material of a wane edge portion of a log originated in mechanical wood processing, said waste wood material comprising laths having an original dimension exceeding the dimension of each respective web or flange, wherein a first contact surface is formed at a side of each opposite flange for co-operation with a second contact surface shaped in a corresponding manner on said central web, wherein each of said first and second contact surfaces are glued together under pressure to form a monolithic entity.

15. A stud or oblong piece according to claim 14, wherein said lath waste wood material is laths which are formed in pairs of a wane edged edge board or outside board which is obtained from the log.

16. A stud or oblong piece according to claim 14, wherein at least one longitudinal edge at least two opposite pieces of said lath material is machined to form adjacent intermeshed groove and tongue formations, so that the longitudinal edge comprises at least two tongues.

* * * * *